United States Patent [19]

Rhee

[11] 4,287,610

[45] Sep. 8, 1981

[54] PROTECTIVE DEVICE WITH SHAPE DEVELOPING AND SECURING MEMBER

[76] Inventor: Jhoon G. Rhee, 2000 L St., NW., Washington, D.C. 20036

[21] Appl. No.: 79,417

[22] Filed: Sep. 27, 1979

[51] Int. Cl.[3] ..... A41D 13/10

[52] U.S. Cl. ..... 2/18; 2/161 A

[58] Field of Search ..... 2/16, 18, 20, 161 A

[56] References Cited

U.S. PATENT DOCUMENTS

| | | | |
|---|---|---|---|
| 3,626,515 | 12/1971 | Murray | 2/161 A |
| 3,945,045 | 3/1976 | Rhee | 2/18 X |
| 4,198,708 | 4/1980 | Fugere | 2/16 |

*Primary Examiner*—Louis Rimrodt

*Attorney, Agent, or Firm*—James C. Wray

[57] ABSTRACT

A means for forming a protective or like device, wherein a development member is provided which forms the contoured surface of the device and the means by which the protective or like device is retained on the particular body member. The novel construction of the development member simplifies construction of the protective or like device and provides a contour which enables the protective or like device to more nearly approximate the hand position which is assumed during use of the protective or like device. Various modifications are adapted to cover various protective devices for the hand, wrist, arm and elbow.

16 Claims, 27 Drawing Figures

FIG. 16
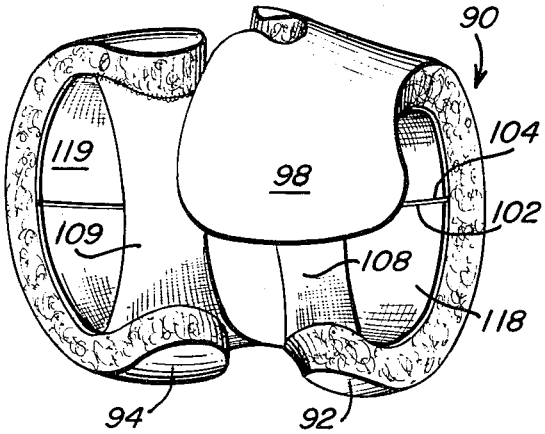
FIG. 17
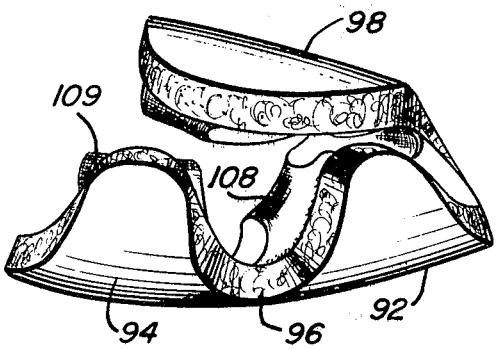
FIG. 18
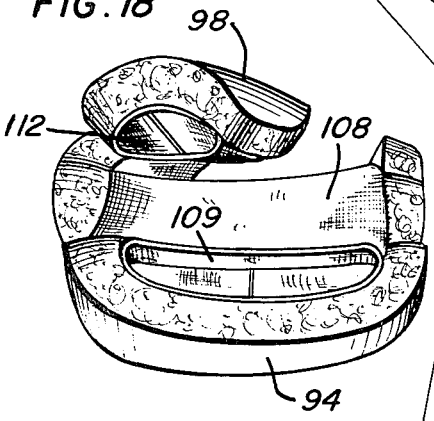
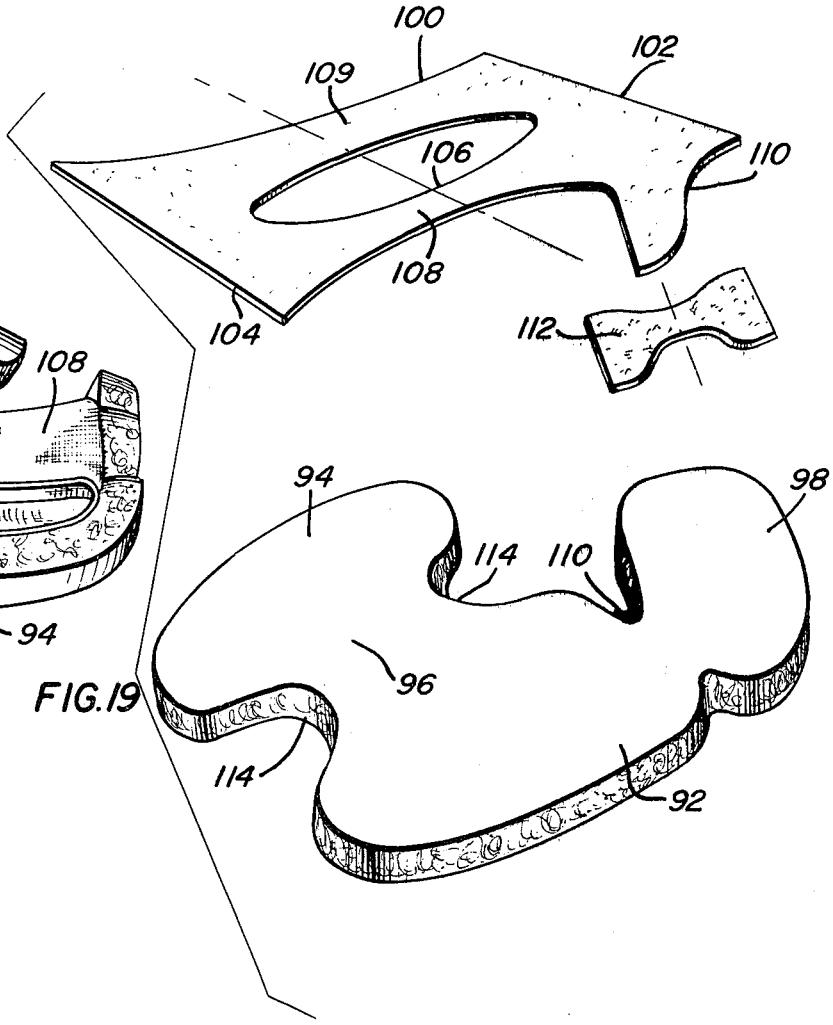
FIG. 19

130
25
136
132
140
138
134
26
108
109
98
112
100
92
96
94
27
140
136
98
100
109
108

PROTECTIVE DEVICE WITH SHAPE DEVELOPING AND SECURING MEMBER

BACKGROUND OF THE INVENTION

This invention relates to protective athletic devices useful during training, practice and actual playing of athletic contests. More particularly, the invention relates to a novel means by which athletic or similar devices can be constructed to provide a simplified securing means for retention of the device on the wearers body member.

In protective devices for athletic or similar protective uses the securing means for the device have generally comprised strap means by which the device is fastened to the wearer's body member. The devices have not been provided with a unitary securing means wherein the securing means forms a pocket means for the wearers body member. In addition, the devices previously known in the art have not provided a unitary development member wherein the development member provides a securing means and a means for generating the contoured form of the device. The present invention provides various embodiments and modifications for providing a development member wherein the securing means and contoured form of the device are formed by the use of a unitary development member.

SUMMARY OF THE INVENTION

It is an object of this invention to provide novel devices for use in athletic or like events which are designed to provide a development member as a securing means.

Another object of this invention to provide novel devices for use in athletic or like events wherein a development member provides a securing means and a contoured form to the device.

Another object of this invention is to provide a novel development member of simplified construction, relatively inexpensive and which will retain the device on the wearers body member while engaging in athletic or like events.

Another object of this invention is to provide a novel protective glove and development member which permits the hand of the wearer to be used with the fingers wherein the natural contour of the glove corresponds to the contour of the wearer's bent fingers.

A further object of the invention is to provide various embodiments and modifications of the development member wherein the development member comprises a novel means for retaining the glove, athletic or like device on the wearer's body member.

Generally, the development member comprises a generally rectangular contoured pattern having a flexible characteristic to it. The development member is used in association with a athletic, protective or like device comprising a resilient, flexible material which is shaped and adapted to generally cover the surfaces of a body member. The development member is also designed to allow the associated device to be easily put on or taken off by the wearer.

The development member has three concurrent functions. The development member provides and holds the shape of the overall device. The development member reinforces the device. The strength of the development member enforces and prevents tearing of the overlying protective cushion member. The development member provides the means for gripping the device and securing the device to the body of a user in the form of pockets or straps.

Other features and advantages of the invention will become apparent from the following description of specific embodiments of the development member and associated devices taken in connection with the drawings.

BRIEF DESCRIPTION OF THE DRAWINGS

FIG. 16 is a bottom view of a modified form of a hand protector.

FIG. 17 is a side elevation of the hand protector shown in FIG. 16.

FIG. 18 is an end elevation of the hand protector shown in FIGS. 16 and 17.

FIG. 19 is an exploded view of the elements of the hand protector shown in FIGS. 16-18.

DETAILED DESCRIPTION OF THE DRAWINGS

Figure 1:
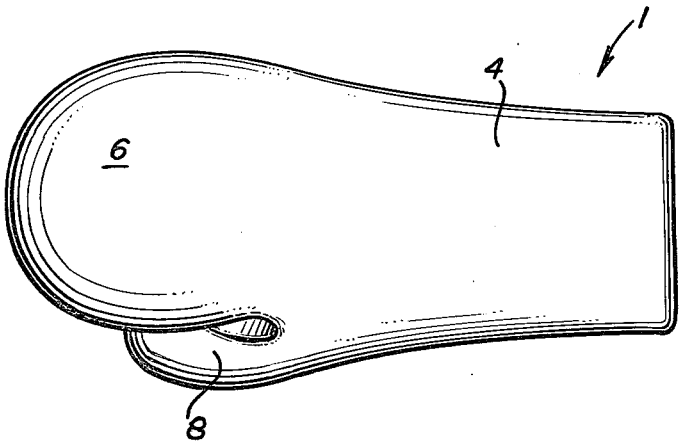
FIG. 1 is a plan view of a device constructed according to the present invention.
Figure 2:
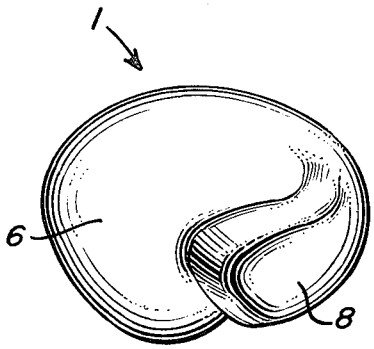
FIG. 2 is an end view of the device shown in FIG. 1.
Figure 3:
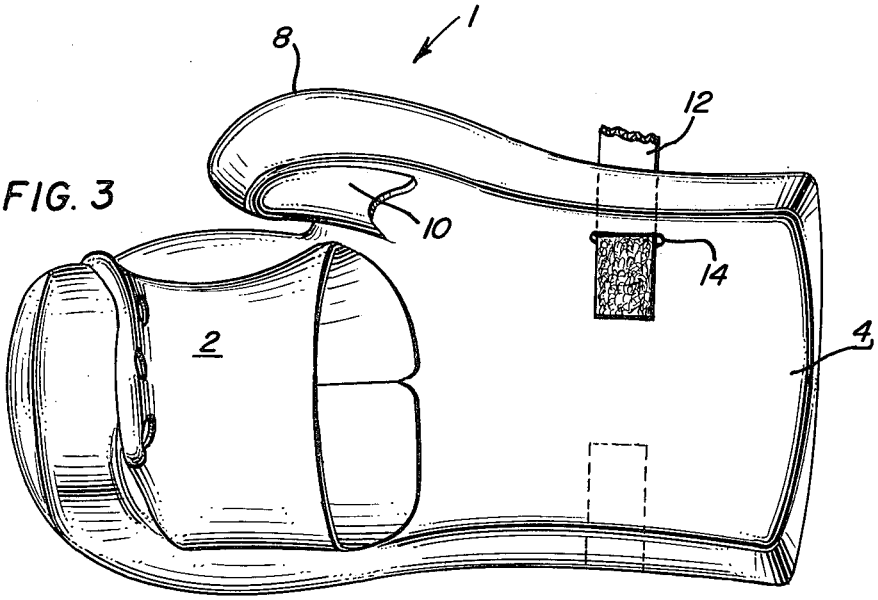
FIG. 3 is a bottom view of the device shown in FIGS. 1 and 2.

Referring to the drawings, a protective glove for use in athletic activities and constructed according to the present invention is generally referred to by the numeral 1 in FIGS. 1, 2 and 3. The glove is formed out of sheet material which is held in a curved position by the development and securing member generally indicated by the numeral 2 in FIG. 3.

The glove has a wrist-covering portion 4 and connected finger-covering portion 6 and thumb-covering portion 8. The glove has a thumb development and securing member 10 which may be constructed to curve the thumb-covering portion 8 and to secure the glove to a thumb of a wearer. A strap 12 passes through an opening 14 in the wrist-covering portion 4 to hold the wrist-covering portion on the wrist of a wearer.

Figure 4:
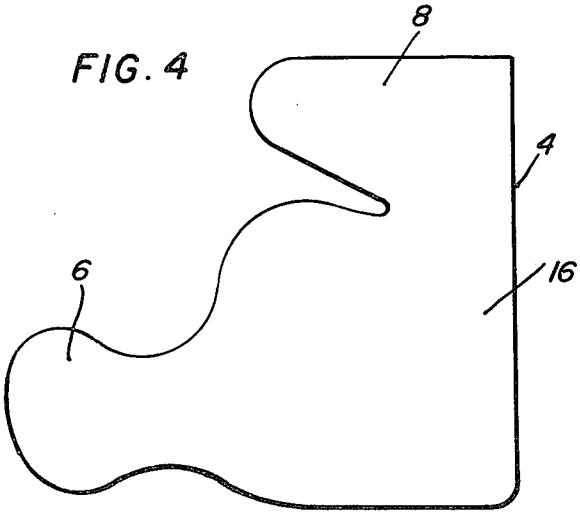
FIG. 4 is a pattern for sheet material used in constructing a hand portion of a device similar to that shown in FIGS. 1 through 4.

As generally indicated in FIG. 4, the glove is constructed of a sheet member 16 which has a wrist-covering portion, shown foreshortened in FIG. 4. The finger-covering portion 6 and the thumb-covering portion 8 are integrally formed with the wrist-covering portion 4. Attaching the development and securing member 2 to the sheet 16, as later will be explained, holds the sheet in curved condition.

Figure 5:
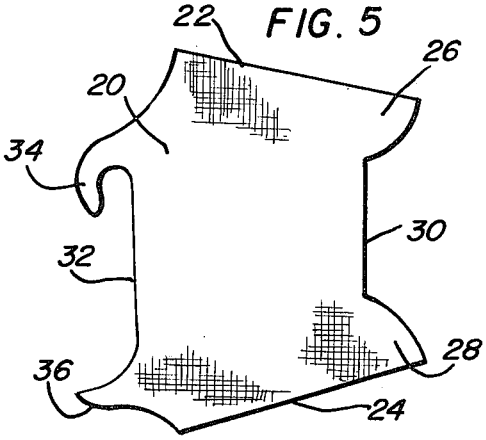
FIG. 5 is a general pattern for a development and securing member of a device constructed according to the present invention.

In FIG. 5 there is described a general form 20 of a development and securing member. Opposite edges 22 and 24 are juxtaposed and the portions 26 and 28 near those edges are bonded to the inner surface of a protective device-forming sheet material, such as glove-forming sheet 16. The simplified member 20 shown in FIG. 5 is a member used on a right-hand glove. Edges 22 and 24 are turned upward and juxtaposed and the glove-forming sheet member is superimposed over the portions 26 and 28 and bonded thereto to curve the sheet member which is preferably formed of a closed-cell, flexible cushioning material.

As shown in FIG. 5, the apparatus forms a glove which will be placed over a right hand, the back of which faces upward from the plane of the drawing, with finger tips curving downward over the edge 30. The heel of the hand overlies edge 32. Hook-shaped portion 34 is bonded to the portion of the sheet material which overlies the thumb of a wearer's hand, curving the sheet material to a proper degree for forming the thumb. Portion 36 is bonded to the portion of sheet material which overlies the outer heel area of a palm, holding the sheet material inward around the outside of the hand.

Preferably, the development and securing member 20 is formed of a flexible, tough material such as a woven fabric or leather or Naugahyde, as an example.

Figure 6:
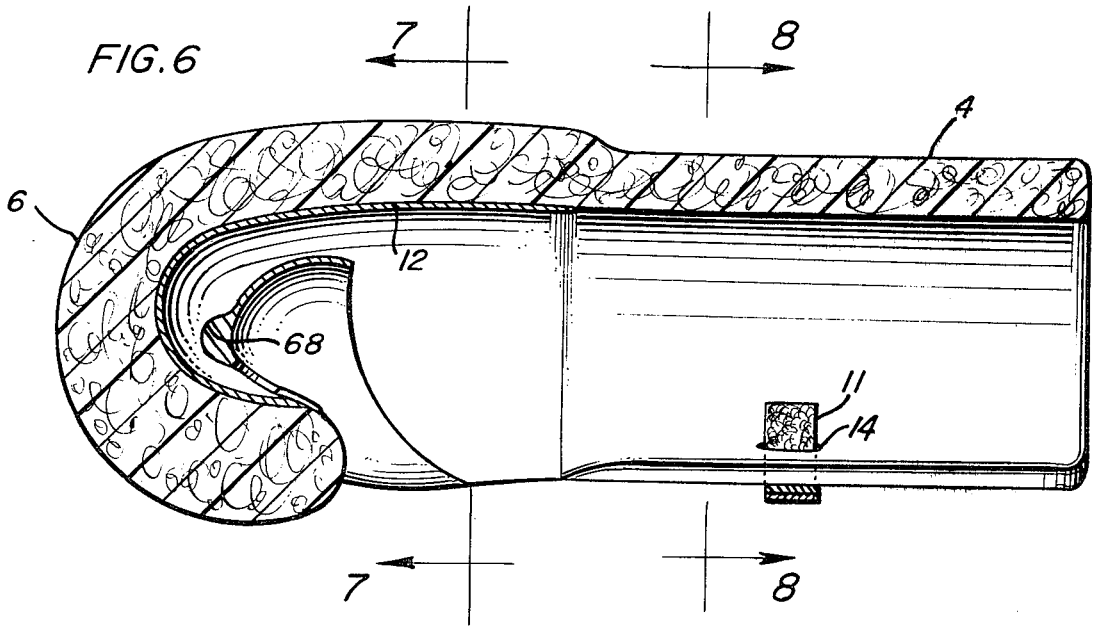
FIG. 6 is a sectional elevation of a device similar to that shown in FIGS. 1 through 3.

FIG. 6 shows a cross-sectional elevation of the glove member shown in FIGS. 1–3. As is seen from the cross-sectional view, the wrist-covering portion 4 may be thinner than the finger-covering portion 6. As is seen from the drawing, the development and securing member 12 is tightly bonded to an inside of the cushion member.

Figure 7:
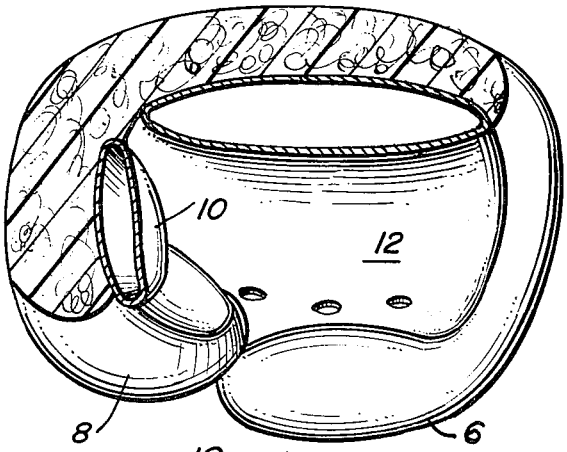
FIG. 7 is a sectional end elevation taken along line 7—7 of FIG. 6.
Figure 8:
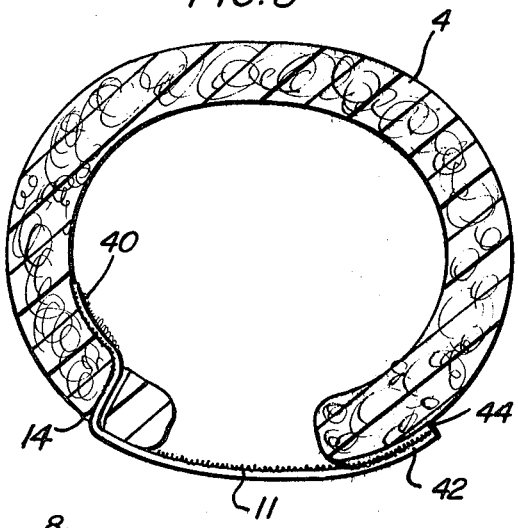
FIG. 8 is an end elevation taken along line 8—8 of FIG. 6.

FIGS. 7 and 8 show cross-sectional view of the apparatus.

FIG. 7 looks from the direction in which fingers and thumb of the wearer's hand are inserted in the securing member 12 and the thumb-securing member 10.

As shown in FIG. 8 the strap 12 on the wrist-covering portion is anchored at one end 40 to an inside of the wrist-covering portion. Strap extends outward through opening 14 and across a gap of the wrist-cover portion. Free end 42 of the strap contains on its inner surface miniature loop-type fasteners which engage complementary miniature hook-type fasteners on strip 44 which is secured to an outside of the wrist-covering portion 4.

Figure 9:
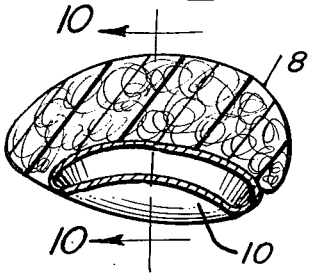
FIG. 9 is a sectional detail of a thumb portion.

FIG. 9 shows a detail of the thumb-covering portion 8 and the thumb-development and securing member 10.

Figure 10:
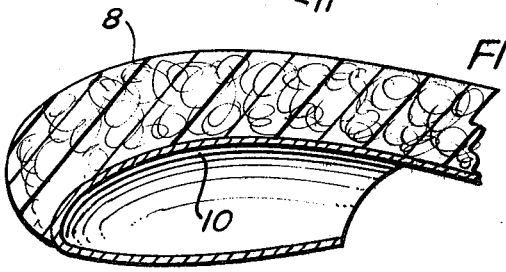
FIG. 10 is a sectional elevational detail taken along line 10—10 of FIG. 9.

FIG. 10 shows a longitudinal detail of the same elements 8 and 10.

Figure 11:
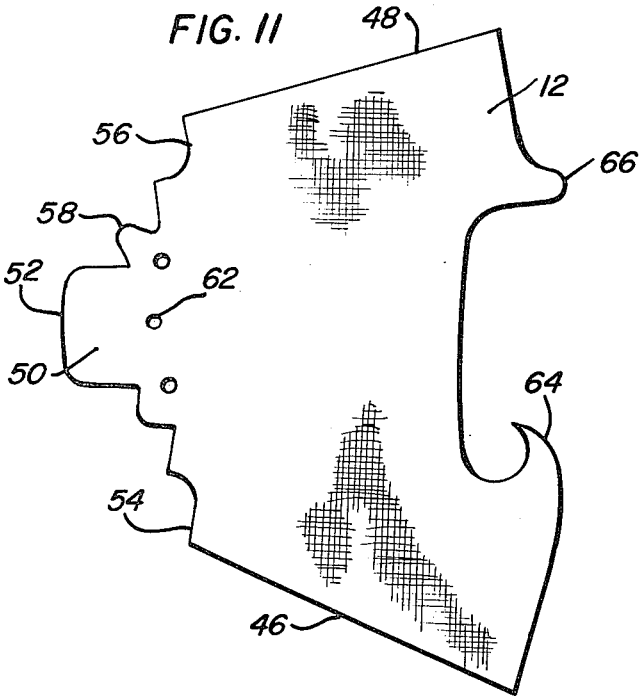
FIG. 11 is a detail showing the development and securing member for use in the device shown in FIGS. 1-3, 6 and 7.
Figure 12:
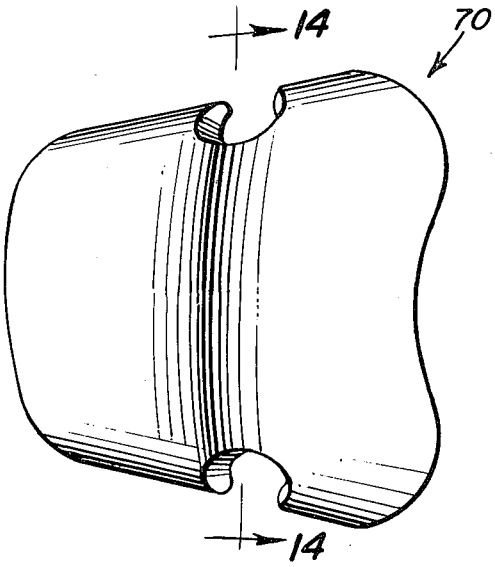
FIG. 12 is a plan view of a hand protective member.
Figure 13:
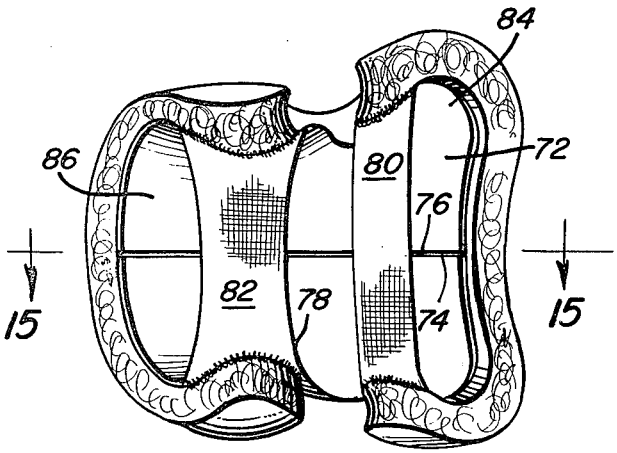
FIG. 13 is a bottom view of the hand protective member shown in FIG. 12.
Figure 14:
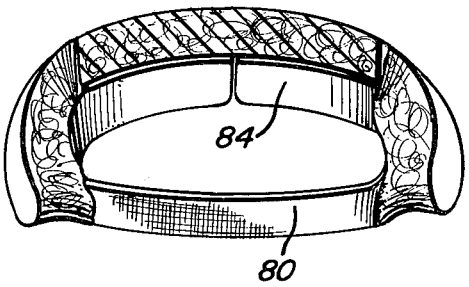
FIG. 14 is a sectional detail of the hand protective member shown in FIGS. 12 and 13.
Figure 15:
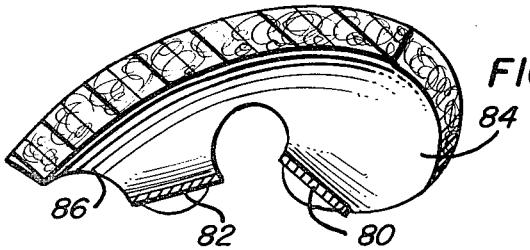
FIG. 15 is a partially sectional elevation of the hand protective member shown in FIGS. 12 and 13 taken along line 15—15 of FIG. 13.
Figure 21:
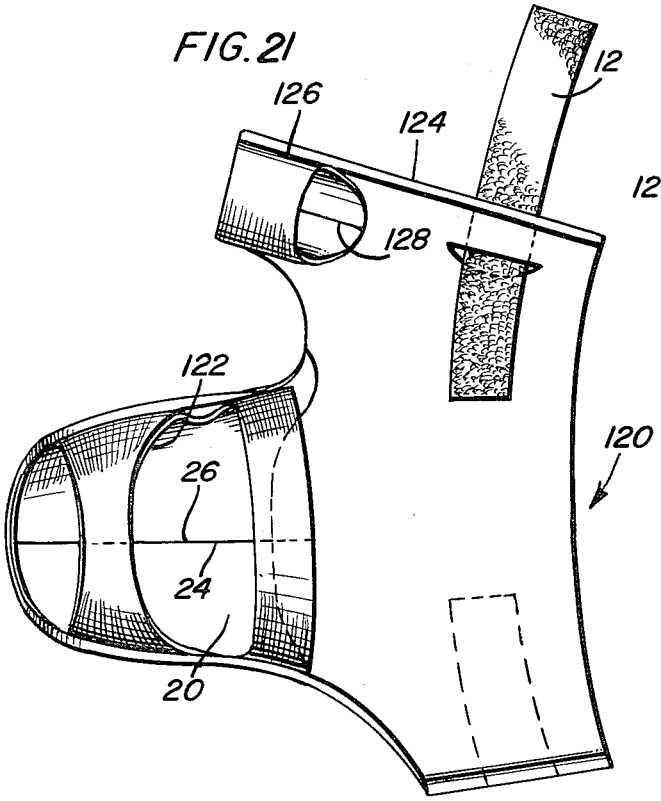
FIG. 21 is a bottom view of the device shown in FIG. 20.
Figure 22:
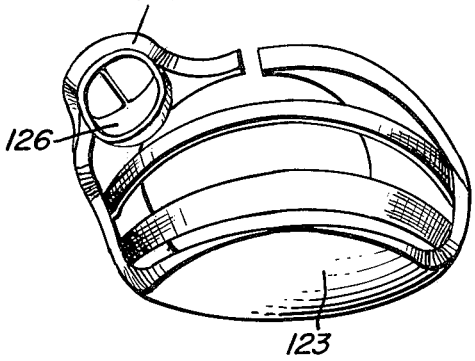
FIGS. 22 and 23 are end elevations of the device shown in FIGS. 20 and 21.

FIG. 11 shows a detail of the development and securing member 12 used on the glove shown in FIGS. 1–3 and 6–10.

The element 12 is shown in a position for use with a glove in the position shown in FIG. 1. Edges 46 and 48 are folded downward and endward and are juxtaposed whereupon portions of the element 12 near the edges 46 and 48 are bonded to an inside of the finger and hand-receiving portion 6 of the sheet material.

Concurrently, flap 50 is folded downward and rearward so that edge 52 is juxtaposed to edges 54 and 56, forming a pocket in which fingertips are received. Edges 58 and 60 are folded and juxtaposed as are other adjacent edges of the cutout development member near flap 50 to form the finger-receiving pockets. Openings 62 permit air circulation through the finger-receiving pocket of the glove. Hook-shaped portion 64 overlies the thumb and draws the glove into a developed curve over the thumb area. Projection 66 draws the glove inward about the outer curvature of the hand-receiving portion. The finger-receiving portion may be formed with a bead 68 such as shown in FIG. 6 to aid the natural curvature of the fingers and retention of the glove on a hand during use.

In a modified form of the invention, the developmental and securing member is used to curve a knuckle-covering protective device 70 shown in FIGS. 12 through 15. The development and securing member 72 is formed of a sheet having opposite edges 74 and 76 which are juxtaposed. A central opening 78 in the sheet separates and forms bands 80 and 82. The unique shape of the developmental and securing member curves the flat, contoured edge sheet of foam material from which the device 70 is constructed.

Fingers are inserted through opening 84 and fingertips project through opening 86.

While the device may be flexed in use, the basic curvature of the device is provided by the development and securing member which functions first to shape the foam cushion material and second to hold the cushion material on the hand of a wearer.

A modification of the device shown in FIGS. 12–15 with an additional thumb protecting part is shown in FIGS. 16–19.

The knuckle and thumb protecting device 90 has a back-of-the-hand covering portion 92 and a finger-covering portion 94 joined intermediately with a knuckle-covering portion 96. A thumb-covering portion 98 completes the cushion element. The shape developing and securing member 100 has edges 102 and 104 which are juxtaposed when the member is bonded to the cushion. A central opening 106 forms separate bands 108 and 109. The thumb-forming extension 110 in cooperation with the thumb-shaping and encircling member 112 form the thumb-receiving portion and hold it in the proper orientation with respect to the protective device 90.

Cutout portions 114 in the cushion enable the device to be curved by the shaping and securing member 100. Cutout portion 116 allows the thumb-covering portion 98 to be curved inward by the shaping and securing members 100 and 112. In use, the fingers are inserted through opening 118 and fingertips extend outward through opening 119.

Figure 23:
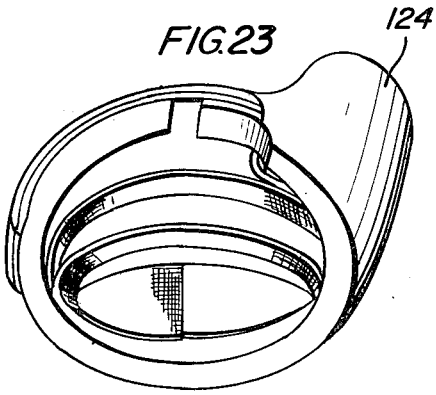
Figure 20:
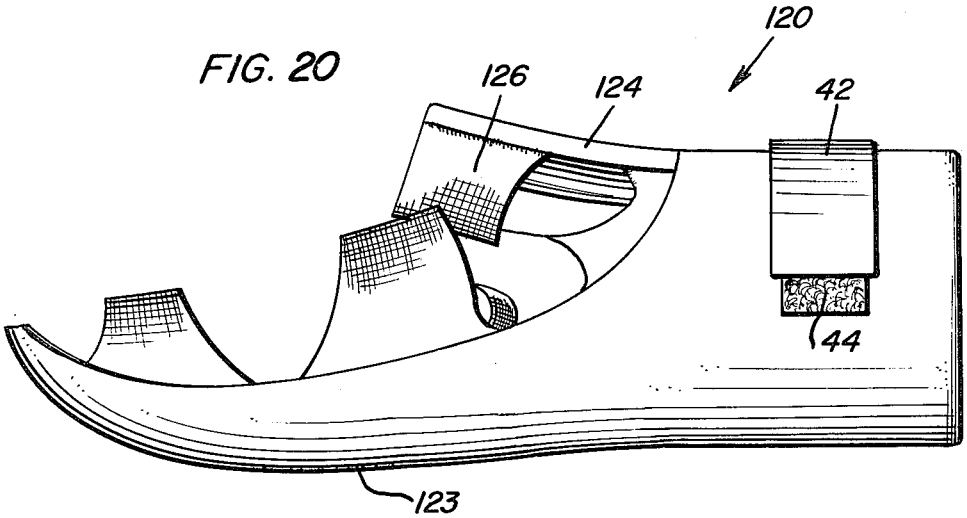
FIG. 20 is a side elevation of the hand and wrist protective device constructed according to the present invention.
Figures 24, 25, 26, 27:
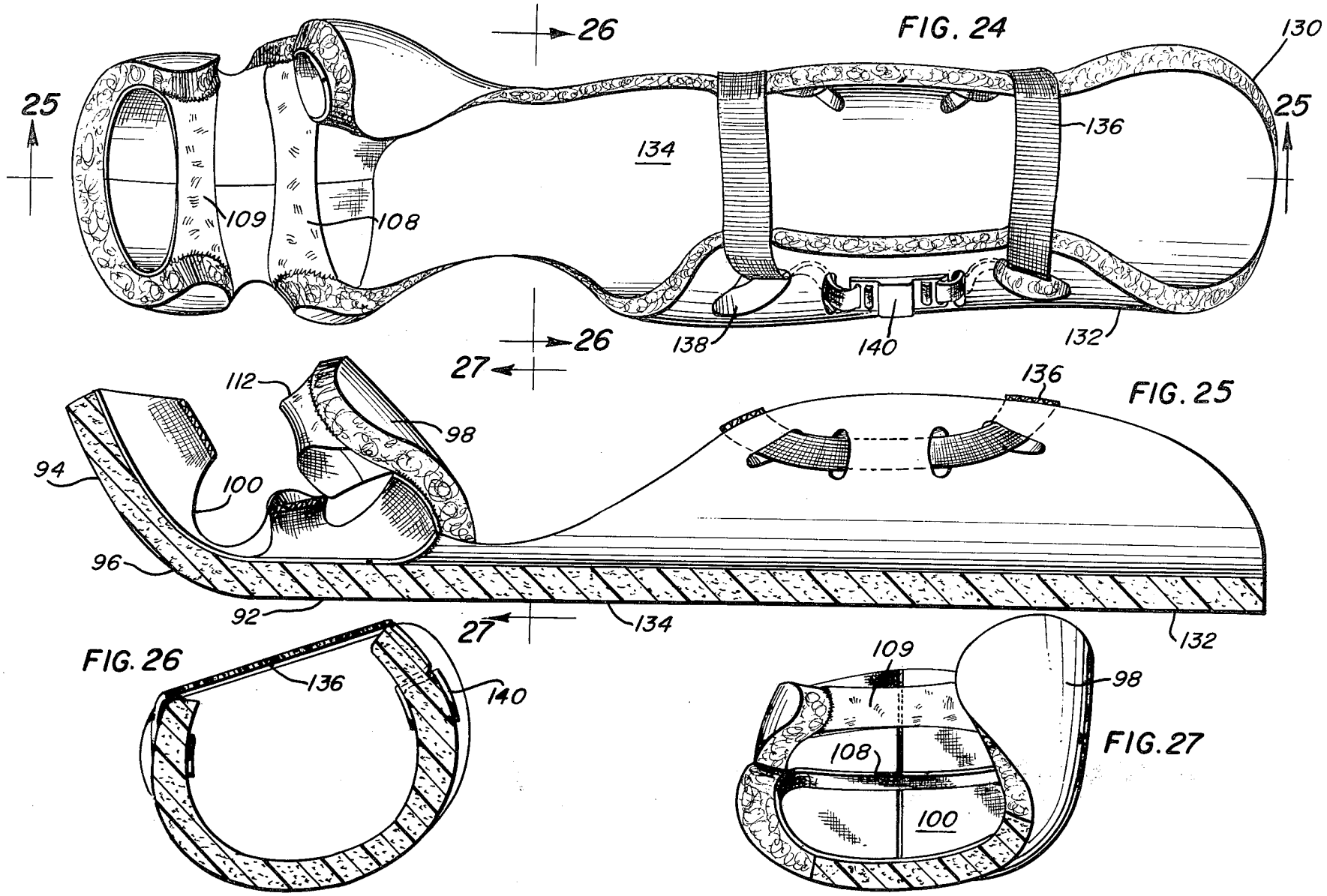
FIG. 24 is a bottom view of a hand, wrist and arm protector constructed according to the present invention.
FIG. 25 is a sectional side elevation of the device shown in FIG. 24.
FIG. 26 is a sectional view taken along line 26—26 of FIG. 24.
FIG. 27 is a sectional view taken along line 27—27 of FIG. 25.

A modified form of the invention is shown in FIGS. 20 and 23.

The wrist, thumb, and hand covering 120 uses the basic shape development and securing member 20 as shown in FIG. 5, modified only by the addition of a central cutout portion 122.

Edges 24 and 26 of the shape developing member 20 are juxtaposed and bonded to an inside of the hand and finger-covering portion 123. The thumb receiving portion 124 is curved by a thumb shaped developing and thumb securing member 126 having abutting edges 128.

A strap 12 similar to the straps shown in FIGS. 3, 6, and 8 is used in the device as shown in FIGS. 20–23.

The embodiment of the invention 130 shown in FIGS. 24 through 27 is a modification of the embodiments shown in FIGS. 12 through 19.

The invention has a hand-covering portion 92 and a finger-covering portion 94 with an intermediate knuckle-covering portion held in curved position by the shape development and securing member 100. Bands 108 and 109 extend across the inside of the hand when the device is in use. Thumb shaping member 112 shapes the thumb-covering portion 98. A forearm-covering portion 132 extends outward from a wrist-covering portion 134. The forearm-covering portion is held in curvature by a single strap 136 which extends through openings 138 in the sides of the forearm-covering portion.

A buckle 140 secures the ends of the straps to curve the cushioning member and to snuggly fit the forearm protective portion on the forearm of a user.

In a preferred form of the invention the outer protective member is formed of a closed-cell foam material provided in sheet form. The protective member is preferably formed of any low density impact absorbing material.

In the preferred form of the invention the shape development member is formed of a supple material which is either non-stretchable or elastic within the forces which are inherent in the present use. Preferably the material of the shaped development member has a surface which is compatible with direct skin contact over a prolonged period.

A suitable material has been found to be an imitation leather material with a soft knitted mesh fabric on the inside of a tough supple and slightly elastic leather-like material.

The outer protective member is bent to its desired shape. This tends to stretch an outer surface of the protective member and tends to compress an inner surface of the protective member. With the protective member held in its desired form, convergent opposite edges of the shape development member are juxtaposed and the shape development member is pressed against the inner, compressed surface of the protective member. The bonding tends to maintain the inner surface of the protective member in compression, thus maintaining the desired shape. Unbonded portions of the shape development member extend across open inner curved portions of the protective member tending to hold the protective member in the desired curvature by tension in the unbonded portions of the shape development member. Preferably the shape development member is bonded to the entire inner curved portion of the protective member.

In a preferred embodiment of the invention the protective member is formed with a relatively dense outer skin and uniform lesser density throughout its thickness and inner surface. Upon distorting the foam member to its desired shape, the less dense inner skin is compressed to greater extent than the more dense outer skin is stretched. Bonding the compressed inner surface to the shape development member retains that compressed condition and retains the desired curvature.

In a preferred form of the invention a non-memory type of foam may be used which tends to retain its new shape after bending. The shape development member reinforces the tendency to retain the new shape.

While the invention has been described with reference to specific embodiments, modifications and variations of the invention may be made without departing from the scope of the invention which is defined in the following claims.

I claim:

1. A protective device for wearing on a body member of a user comprising a resilient cushion-like sheet protective member and a flexible sheet-like shape developing member bonded to an inside of the protective member; wherein the shape developing member has a portion which is not bonded to the protective member and which extends across the inward curvature of the protective member whereby forming a securing means for securing the protective device to the body of the wearer.

2. The protective device as claimed in claim 1 wherein the protective member has lateral cutout portions for facilitating transverse bending of the protected member and interfitting of lateral portions thereof.

3. The protective device as claimed in claim 1 wherein the shape development member has spaced opposite converging edges whereby the opposite edges are juxtaposed and portions of the shape development member adjacent the edges are bonded to an inner surface of the protective member for holding the protective member in the desired contoured shape.

4. The protective device as claimed in claim 3 wherein the shape development member and the protective member cover a back of the hand, knuckles, and a portion of the fingers adjacent the knuckles.

5. The protective device as claimed in claim 4 further comprising strap portions of the shape development member underlying a portion of a palm of a hand and an inside portion of fingers and further comprising cutaway portions of the protective member and the shape forming member adjacent lateral areas of a hand adjacent the knuckles.

6. The protective device of claim 5 wherein the protective member further comprises a thumb overlying portion integrally formed with the protective member and further comprising a thumb portion shape development member bonded to an inside of the thumb portion of the protective member and forming a strap member free of the protective member and underlying a thumb of a wearer.

7. The protective device as claimed in claim 6 further comprising a wrist-covering portion integrally formed on the protective member and strap means connected to the wrist-covering portion and extending partially therearound for securing the wrist-covering portion around the wrist of a user.

8. The protective device as claimed in claim 7 wherein the strap has one end joined to an inside of the wrist-covering portion, wherein the strap extends through an opening in the wrist-covering portion and extends outward from the opening and wherein an opposite end of the strap has small loop-type fasteners which engage a strip of hook-type fasteners mounted on an outer surface of the wrist-covering portion.

9. The protective device as claimed in claim 7 wherein the shape development member has at a convergent end thereof a medial outward extending flap which is folded toward convergent ends of the edges thereby forming a pocket for fingertip areas of a wearer.

10. The protective device as claimed in claim 9 further comprising a bead formed across an inside of the shape development member near convergent ends of the opposite edges for underlying distal portions of the fingers.

11. The protective device as claimed in claim 9 further comprising openings through the shape development member near the flap for providing air circulation.

12. The protective device as claimed in claim 4 further comprising a forearm partially surrounding portion connected to the wrist overlying portion and extending outward therefrom and strap means connected to the forearm overlying portion for securing the forearm overlying portion to the forearm of a user.

13. The protective device as claimed in claim 12 wherein the strap means further comprises a buckle and means for adjustably attaching the strap to the buckle whereby the strap may be individually adjusted for the size of the forearm of a user and the buckle may be connected and released for tightening the forearm protecting portion around the forearm of the user and for releasing the portion therefrom.

14. The apparatus of claim 13 further comprising plural openings in opposite portions of the forearm-covering portion whereby the strap means comprises a single strap which is threaded through the openings.

15. A protective device comprising an outer member consisting of a resilient foam cushion material having a body and inner surface of relatively uniform density and having an outer skin of increased density, the protective member being bent and contoured to a desired shape and a flexible shape development member having an elastic outer surface bonded to an inner surface of the protective member wherein the inner surface of the protective member is compressed upon being bent and wherein the outer surface of the shape development member being bonded to the inner surface of the protective member retains said inner surface in its compressed state and thus retains the shape of the protective member and protected device.

16. The protective device of claim 15 wherein an unbonded portion of the shape development member extends across an inner curvature of the protective member thereby forming a means for securing the protective device on a body member of a user.

* * * * *